US008733136B2

(12) United States Patent
Chung et al.

(10) Patent No.: US 8,733,136 B2
(45) Date of Patent: May 27, 2014

(54) WASHING MACHINE

(75) Inventors: Seung Hwan Chung, Suwon-si (KR); Yong Myoung Kim, Suwon-si (KR); Byung Don Jung, Seoul (KR); Seung Kwun Ahn, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 389 days.

(21) Appl. No.: 12/458,210

(22) Filed: Jul. 2, 2009

(65) Prior Publication Data

US 2010/0000266 A1 Jan. 7, 2010

(30) Foreign Application Priority Data

Jul. 4, 2008 (KR) ..... 10-2008-0065046

(51) Int. Cl.
*D06F 39/08* (2006.01)

(52) U.S. Cl.
USPC ..... 68/23.5; 68/207

(58) Field of Classification Search
USPC ..... 68/207, 23.5; 134/199; 239/550
See application file for complete search history.

(56) References Cited

U.S. PATENT DOCUMENTS

| | | | | | |
|---|---|---|---|---|---|
| 876,453 | A | * | 1/1908 | Heard | 239/117 |
| 978,597 | A | * | 12/1910 | Kennedy | 239/602 |
| 1,102,354 | A | * | 7/1914 | Pougnet | 239/550 |
| 1,200,289 | A | * | 10/1916 | Wittemann | 134/199 |
| 1,358,507 | A | * | 11/1920 | Patrick | 134/139 |
| 1,867,634 | A | * | 7/1932 | Snyder | 134/172 |
| 2,161,047 | A | * | 6/1939 | Holden | 4/618 |
| 2,254,003 | A | * | 8/1941 | De Marco | 68/196 |
| 2,501,887 | A | * | 3/1950 | Cress | 134/148 |
| 2,543,993 | A | * | 3/1951 | Stanitz et al. | 134/141 |
| 2,563,046 | A | * | 8/1951 | Ernest | 68/23 R |
| 2,563,109 | A | * | 8/1951 | Franklin | 134/148 |
| 2,689,577 | A | * | 9/1954 | Dunn et al. | 134/123 |
| 2,699,057 | A | * | 1/1955 | Paine | 68/23.6 |
| 3,062,454 | A | * | 11/1962 | Cocks | 239/422 |
| 3,169,540 | A | * | 2/1965 | Moore et al. | 134/191 |
| 3,335,584 | A | * | 8/1967 | Urban | 68/207 |
| 3,388,410 | A | * | 6/1968 | Marshall | 8/158 |
| 3,742,736 | A | * | 7/1973 | Fish et al. | 68/23.5 |
| 4,519,223 | A | * | 5/1985 | Wasemann | 68/23.5 |
| 4,784,666 | A | * | 11/1988 | Brenner et al. | 8/137 |
| 4,986,093 | A | * | 1/1991 | Pastryk et al. | 68/13 R |

(Continued)

FOREIGN PATENT DOCUMENTS

| | | |
|---|---|---|
| CN | 1246552 | 3/2000 |
| CN | 2383860 | 6/2000 |

(Continued)

OTHER PUBLICATIONS

Office Action issued by the Chinese Patent Office on Oct. 21, 2011 in the related Chinese patent application.

*Primary Examiner* — Joseph L Perrin
(74) *Attorney, Agent, or Firm* — Staas & Halsey LLP

(57) ABSTRACT

A washing machine has a water spray device to efficiently wet the laundry by spraying washing water to the laundry with uniform pressure. The washing machine includes an outer tub, and a water spray device installed at an upper portion of the outer tub to spray washing water. The water spray device includes a diffusion duct for diffusing the washing water around the outer tub and a spray member provided in the diffusion duct to spray the washing water into the outer tub.

18 Claims, 10 Drawing Sheets

(56) References Cited

U.S. PATENT DOCUMENTS

| | | | | | |
|---|---|---|---|---|---|
| 5,028,007 | A | * | 7/1991 | Wokal | 239/518 |
| 5,167,722 | A | * | 12/1992 | Pastryk et al. | 134/33 |
| 5,285,664 | A | * | 2/1994 | Chang et al. | 68/18 F |
| 5,307,651 | A | * | 5/1994 | Felzer | 68/23.5 |
| 5,582,039 | A | * | 12/1996 | Mueller et al. | 68/17 R |
| 5,590,552 | A | * | 1/1997 | Kim | 68/207 |
| 5,657,650 | A | * | 8/1997 | Lee et al. | 68/23.5 |
| 5,687,440 | A | * | 11/1997 | Min et al. | 8/158 |
| 5,823,018 | A | * | 10/1998 | Lee | 68/23.5 |
| 5,937,677 | A | * | 8/1999 | Lee | 68/23.5 |
| 6,058,743 | A | * | 5/2000 | Fujii et al. | 68/12.18 |
| 6,065,171 | A | * | 5/2000 | Tubman et al. | 8/158 |
| 7,424,810 | B2 | * | 9/2008 | Zaccone et al. | 68/23.5 |
| 2005/0273945 | A1 | * | 12/2005 | Zaccone et al. | 8/159 |
| 2007/0107471 | A1 | * | 5/2007 | Zaccone et al. | 68/3 R |

FOREIGN PATENT DOCUMENTS

| | | | |
|---|---|---|---|
| JP | 64-020897 | * | 2/1989 |
| KR | 20-1995-009063 | | 4/1995 |
| RU | 2 951 248 | * | 12/1995 |
| SE | 9200856 | * | 9/1993 |

* cited by examiner

WASHING MACHINE

CROSS-REFERENCE TO RELATED APPLICATIONS

This application claims the benefit of Korean Patent Application No. 10-2008-0065046 filed on Jul. 4, 2008, in the Korean Intellectual Property Office, the disclosure of which is incorporated herein by reference.

BACKGROUND

1. Field

The present invention relates to a washing machine. More particularly, the present invention relates to a washing machine having a water spray device to efficiently wet the laundry.

2. Description of the Related Art

In general, washing machines are classified into pulsator type washing machines and drum type washing machines according to the washing scheme thereof. The pulsator type washing machine includes an outer tub for storing washing water, a rotating tub rotatably installed in the outer tub to receive the laundry therein, and a pulsator installed at the bottom of the rotating tub to generate swirl flow.

Such a washing machine has a water circulation device which circulates washing water from the bottom of the outer tub to the top of the outer tub using rotating force of the pulsator.

The water circulation device includes ribs protruding from a lower portion of the pulsator to pump up washing water from the bottom of the outer tub as the pulsator rotates, and a circulation path which guides the washing water pumped by the ribs toward the top of the outer tub. The circulation path is formed between the rotating tub and a circulation panel installed at an inner peripheral surface of the rotating tub.

In operation of the water circulation device, washing water is fed into the outer tub until the washing water reaches a predetermined level in the outer tub and then the pulsator rotates in the forward and reverse directions by a motor, so that the washing process or the rinsing process for the laundry is performed. As the pulsator rotates in the forward and reverse directions, the ribs pump up the washing water from the bottom of the rotating tub and the washing water pumped by the ribs passes through the circulation path. Then, the washing water is introduced into the top of the rotating tub through the circulation path and the dropped down into the rotating tub.

After that, when the washing and rinsing processes have been completed, the rotating tub rotates at a high speed to dehydrate the laundry.

SUMMARY

Washing performance of the washing machine may be improved as the washing water drops down from a higher position because a friction force between the washing water and the laundry is increased. However, according to the conventional washing machine, the washing water drops down within the height of the rotating tub. That is, since the circulation path is defined by the circulation panel installed at the inner peripheral surface of the rotating tub, it is limited to pump up the washing water to the position higher than the rotating tub.

Accordingly, it is an aspect of the present invention to provide a washing machine having a water circulation device to allow washing water to be dropped down from a top of an outer tub.

Another aspect of the present invention is to provide a washing machine having a water spray device to efficiently wet the laundry by spraying the washing water with uniform pressure.

Still another aspect of the present invention is to provide a washing machine to efficiently wet the laundry by diversifying shapes of the washing water sprayed from the top of the outer tub.

Additional aspects and/or advantages of the invention will be set forth in part in the description which follows and, in part, will be apparent from the description, or may be learned by practice of the invention.

The foregoing and/or other aspects of the present invention are achieved by providing a washing machine including an outer tub and a water spray device installed at an upper portion of the outer tub to spray washing water, wherein the water spray device comprises a diffusion duct for diffusing the washing water around the outer tub and a spray member provided in the diffusion duct to spray the washing water into the outer tub.

A sectional area of the spray member is smaller than a sectional area of the diffusion duct.

The spray member has an inlet port connected to the diffusion duct and an outlet port spaced apart from the diffusion duct, and a sectional area of the inlet port is larger than a sectional area of the outlet port.

The water spray device comprises a guide member provided in the spray member to guide the washing water.

The guide member comprises a spray nozzle coupled with the spray member.

The guide member comprises a rib adjacent to the spray member.

The spray member branches from the diffusion duct.

According to another aspect, the present invention provides a washing machine including an outer tub, a circulation duct for circulating washing water from a bottom to a top of the outer tub, a diffusion duct receiving the washing water from the circulation duct to diffuse the washing water around the outer tub, and at least one water spray device for spraying the washing water stored in the diffusion duct into the outer tub.

The spray member protrudes from the diffusion duct by a predetermined length.

A sectional area of the spray member is smaller than a sectional area of the diffusion duct.

The spray member has an inlet port for receiving the washing water and an outlet port for discharging the washing water, and the inlet port has a sectional area larger than a sectional area of the outlet port.

The washing machine further includes a guide member for guiding the washing water sprayed from the spray member.

The guide member comprises a spray nozzle coupled with the spray member.

The guide member comprises a rib adjacent to the spray member.

A connection part having a predetermined curvature is provided between the diffusion duct and the spray member.

The diffusion duct comprises a cover provided on the outer tub and a diffusion tube formed below the cover to guide the washing water in a circumferential direction around the outer tub.

The spray member comprises a cover provided on the outer tub and a spray tube formed below the cover to guide the washing water into the outer tub.

The diffusion duct is formed by thermally welding the cover with the diffusion tube.

The spray member is formed by thermally welding the cover with the spray tube.

The rib protrudes from a bottom of a cover provided on the outer tub.

The spray member protrudes while being biased from a center of the outer tub.

According to the present invention, the water spray device that sprays washing water from the top of the outer tub increases potential energy of the washing water, so that frictional force between the washing water and the laundry is increased, thus improving washing performance.

In addition, the water spray device sprays the washing water with uniform pressure using a plurality of spray members, so that the laundry can be efficiently wetted by the washing water.

Further, the water spray device uniformly sprays the washing water over the laundry, so that the laundry can be efficiently wetted by the washing water.

In addition, the water spray device has a plurality of spray nozzles having various shapes, so that the shape of the washing water sprayed from the spray nozzle can be diversified, thereby improving the aesthetic feature of the washing process.

Further, since the laundry can be efficiently wetted by the washing water, the washing process can be performed at a low level of the washing water, so that the amount of washing water used for the washing process can be reduced.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
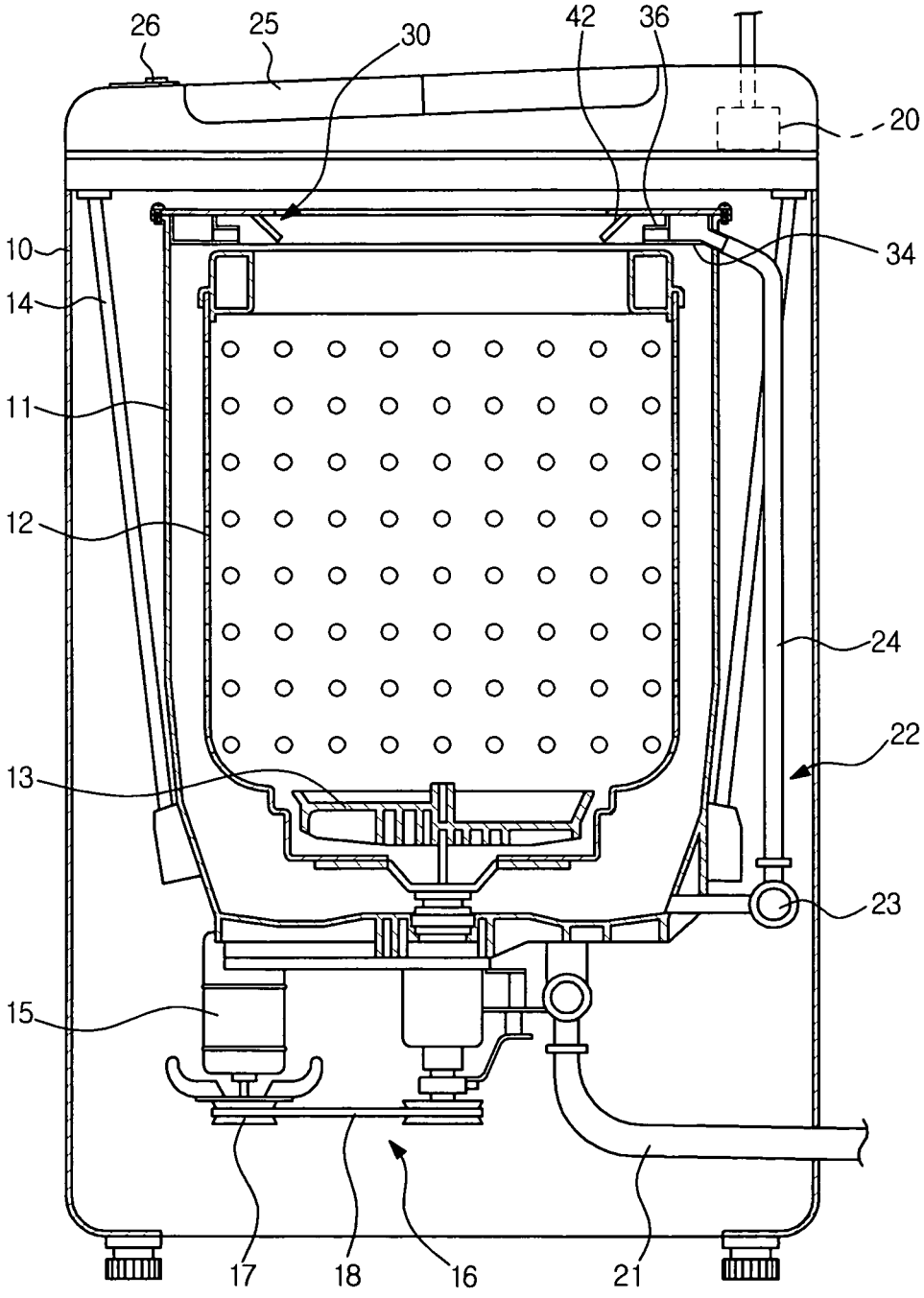
FIG. 1 is a sectional view showing a washing machine according to an embodiment of the present invention.

Reference will now be made in detail to the embodiments of the present invention, examples of which are illustrated in the accompanying drawings, wherein like reference numerals refer to the like elements. The embodiments are described below to explain the present invention by referring to the figures.

FIG. 1 is a sectional view showing a washing machine according to the present invention.

As shown in FIG. 1, the washing machine according to the present invention includes a body 10, an outer tub 11 installed in the body 10, a rotating tub 12 rotatably installed in the outer tub 11, and a pulsator 113 installed on the bottom of the rotating tub 12.

The outer tub 11 is suspended to the body 10 by a suspension device 14. A driving motor 15 for driving the rotating tub 12 and the pulsator 13 and a power transmission device 16 for transferring the driving force of the driving motor 15 to the rotating tub 12 and the pulsator 13 are installed below the outer tub 11. The power transmission device 16 includes a pulley 17, a belt 18, etc.

A water feeding device 20 is installed at an upper portion of the outer tub 11 to feed washing water into the outer tub and a water draining device 21 is installed at a lower portion of the outer tub to drain the washing water out of the washing machine. A circulation device 22 is provided at one side of the outer tub 11 to circulate the washing water contained in the outer tub 11 to the top of the outer tub 11. The circulation device 22 includes a circulation pump 23 for pumping the washing water, and a circulation duct (or circulation pipe) 24 for guiding the washing water pumped by the circulation pump 23 to the top of the outer tub 11. A water spray device 30 is installed at the upper portion of the outer tub 11 to spray the washing water, which is circulated by the circulation device 22, into the rotating tub 12.

A door 25 is provided on the top of the body 10 to allow a user to open or close the body 10 and a control panel 26 is installed at the front portion of the door 25. The user can input or take out the laundry by opening the door 25 and can set the condition of the washing process, such as the type of the laundry, the washing time, and the like.

Figure 2:
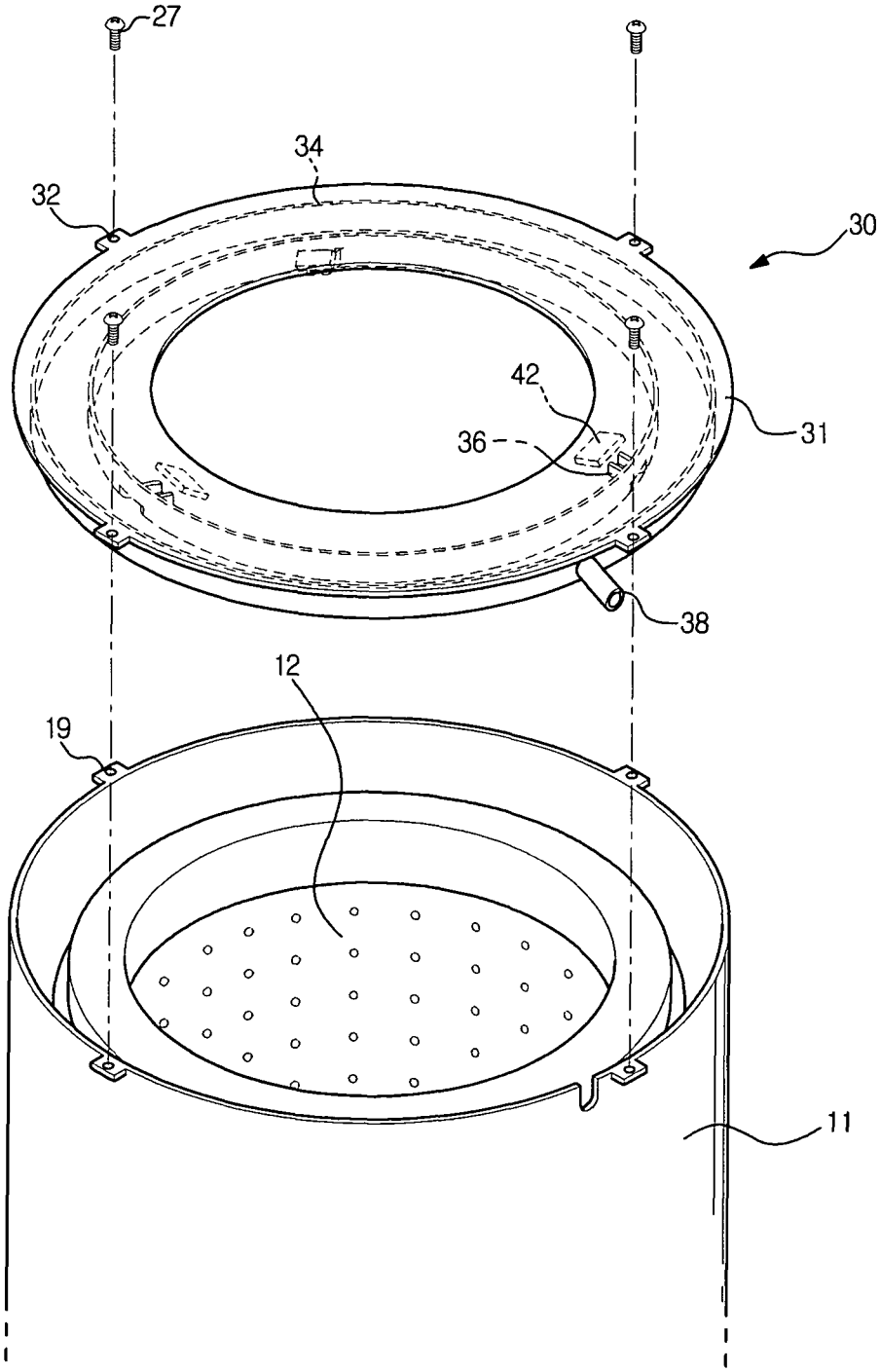
FIG. 2 is an exploded perspective view showing a water spray device according to an embodiment of the present invention.

FIG. 2 is an exploded perspective view showing the water spray device according to the present invention.

FIG. 2 shows the outer tub 11 and the rotating tub 12 installed in the outer tub 11. The water spray device 30 is installed at the upper portion of the outer tub 11 to spray the washing water into the outer tub 11. In detail, the washing water is sprayed into the rotating tub 12 to wet the laundry contained in the rotating tub 12.

The water spray device 30 is provided at an outer peripheral portion thereof with a mounting section 31. The mounting section 31 is rested on an upper peripheral portion of the outer tub 11, so that the water spray device 30 can be coupled to the upper portion of the outer tub 11. Then, first coupling sections 19, which protrude from an upper lateral side of the outer tub 11, are coupled with second coupling sections 32, which protrude from an outer peripheral portion of the mounting section 31, by screws 27 so that the water spray device 30 is fixed to the outer tub 11.

The water spray device 30 blocks a gap formed between the outer tub 11 and the rotating tub 12. That is, the water spray device 30 covers the gap formed between the outer tub 11 and the rotating tub 12, so that the gap may not be seen when the user sees the gap from the top of the washing machine. In addition, impurities can be prevented from being introduced into the gap between the outer tub 11 and the rotating tub 12 due to the water spray device 30.

Referring to FIGS. 1 and 2, the washing water is introduced into the water spray device 30 through a water inlet port 38. The water inlet port 38 is connected to the circulation duct 24 so that the washing water pumped by the circulation pump 23 is introduced into the water spray device 30. In addition, the water inlet port 38 can be connected to the water feeding device 20 (see, FIG. 1). In this case, water supplied from an external water source (not shown) can be sprayed into the outer tub 11 by using the water spray device 30. In addition, the water spray device 30 can be provided with a plurality of water inlet ports 38. For instance, if the water spray device 30 has two water inlet ports 38, one of the water inlet ports 38 is connected to the circulation device 22 and the other is connected to the water feeding device 20. In this case, the water spray device 30 can spray the washing water contained in the outer tub 11 as well as the washing water supplied from the external water source, so that the laundry contained in the rotating tub 12 can be effectively wetted by the washing water.

Figure 3:
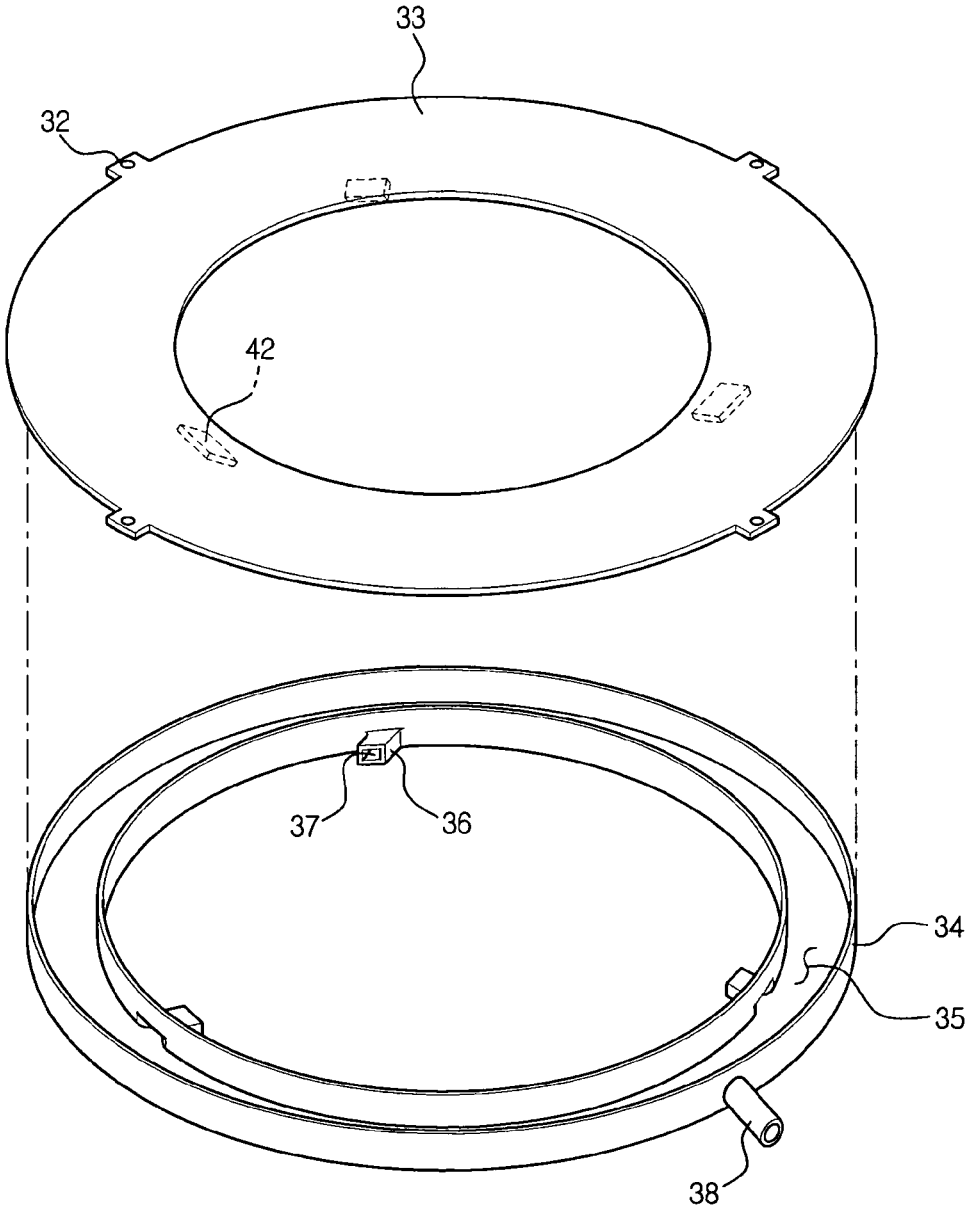
FIG. 3 is an exploded perspective view showing the water spray device according to an embodiment of the present invention.

FIG. 3 is an exploded perspective view showing the water spray device 30 according to the present invention.

As shown in FIG. 3, the water spray device 30 has a cover 33 having a flat ring shape. A diffusion duct 34 having a ring shape is provided below the cover 33 and a plurality of spray members 36 protrude radially inward from the diffusion duct 34 while being spaced apart from each other by a predetermined interval. The diffusion duct 34 is thermally welded to the cover 33 to form a water path for the washing water. The water path defined by the diffusion duct will be called a diffusion path 35. The spray members 36 protrude from an inner peripheral surface of the diffusion duct 34 to form a water path for the washing water. The water path defined by the spray members 36 will be referred to as a spray path 37. The spray members 36 may have various shapes in addition to the shape shown in the drawing. In addition, the diffusion duct 34 may also have various shapes, such as a semicircular shape or an arc shape.

Figure 4:
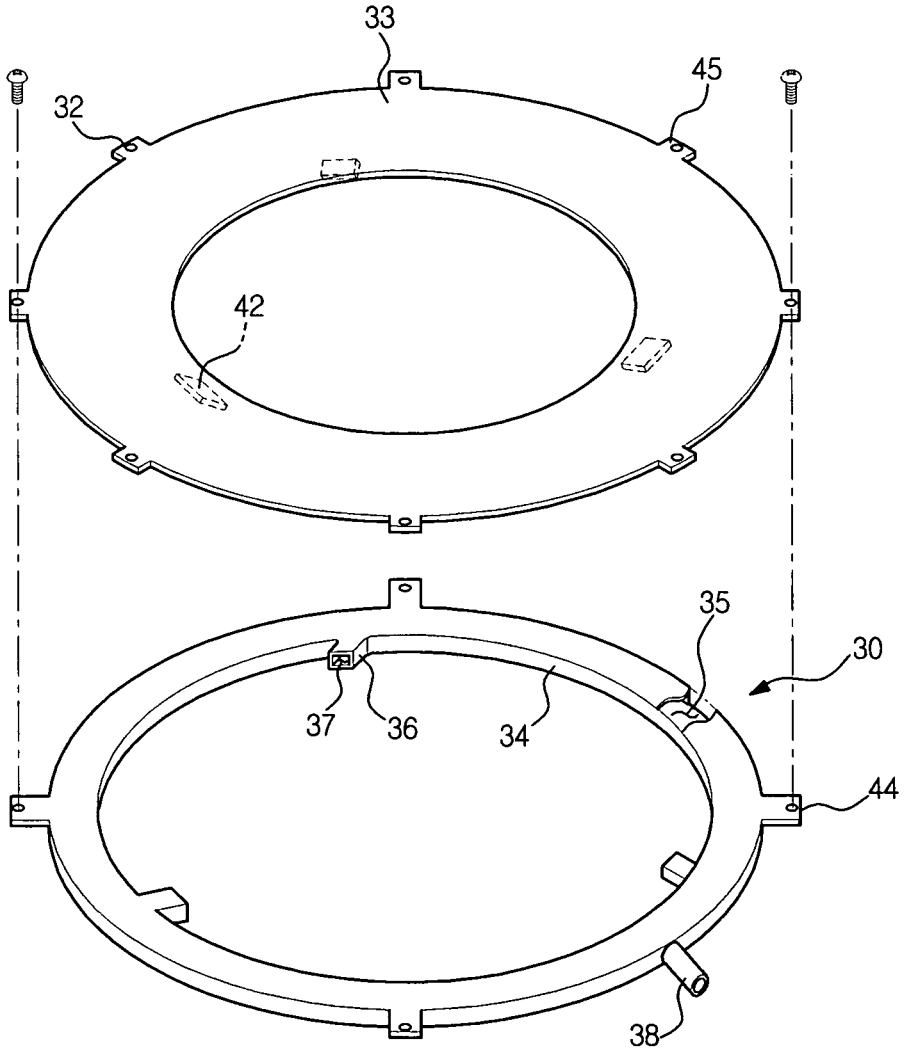
FIG. 4 is an exploded perspective view showing the water spray device according to another embodiment of the present invention.

The water inlet port 38, which is connected to the circulation duct 24, is provided at the outer peripheral surface of the diffusion duct 34. Thus, the washing water passing through the circulation duct 24 is introduced into the diffusion duct 34 through the water inlet port 38. Referring to FIG. 4, the diffusion duct 34 and the spray members 36 may serve as water paths for the washing water.

FIG. 4 is an exploded perspective view showing the water spray device according to another embodiment of the present invention.

The cover 33 shown in FIG. 3 is thermally welded to the diffusion duct 34 to form the water path for the washing water. In contrast, the cover 33 shown in FIG. 4 is provided at the bottom thereof with the water spray device 30. The cover 33 has first coupling sections 44 coupled with the water spray device 30 and the water spray device 30 has second coupling sections 45 coupled with the cover 33. The first coupling sections 44 are fastened to the second coupling sections 45 by screws.

The water spray device 30 includes a diffusion duct 34 having a ring shape and a plurality of spray members 36 which protrude from the diffusion duct 34 while being spaced apart from each other by a predetermined interval. The diffusion duct 34 further includes the water inlet port 38 connected to the circulation duct 24. The water path defined by the diffusion duct 34 will be referred to as the diffusion path 35 and the water path defined by the spray members 36 will be referred to as the spray path 37. The diffusion path 35 diffuses the washing water, which is introduced through the water inlet port 38, in the peripheral direction of the outer tub 11 (see, FIG. 2), and the spray path 37 sprays the washing water into the outer tub 11.

The water spray device 30 shown in FIG. 3 is identical to the water spray device 30 shown in FIG. 4 in terms of the function thereof, but they have different types of water paths for the washing water. The following description will be made with reference to the water spray device 30 shown in FIG. 3.

Figure 5:
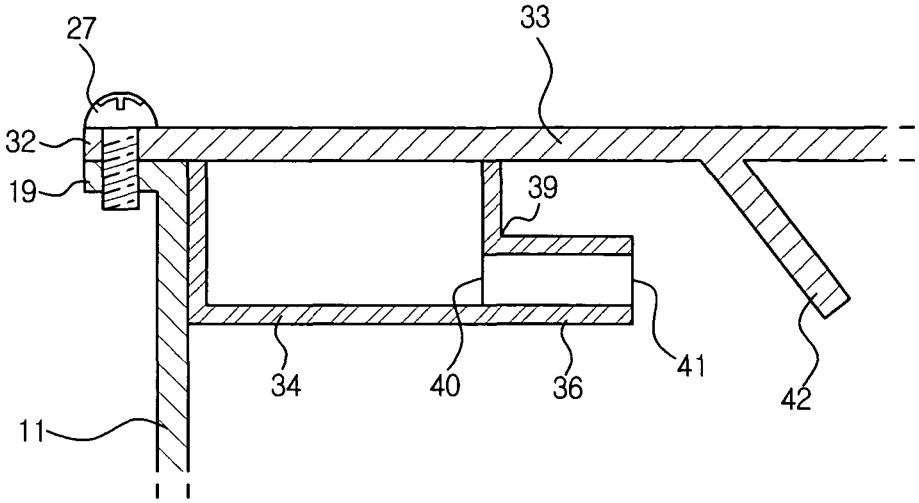
FIG. 5 is a longitudinal sectional view showing the water spray device according to an embodiment of the present invention.
Figure 6:
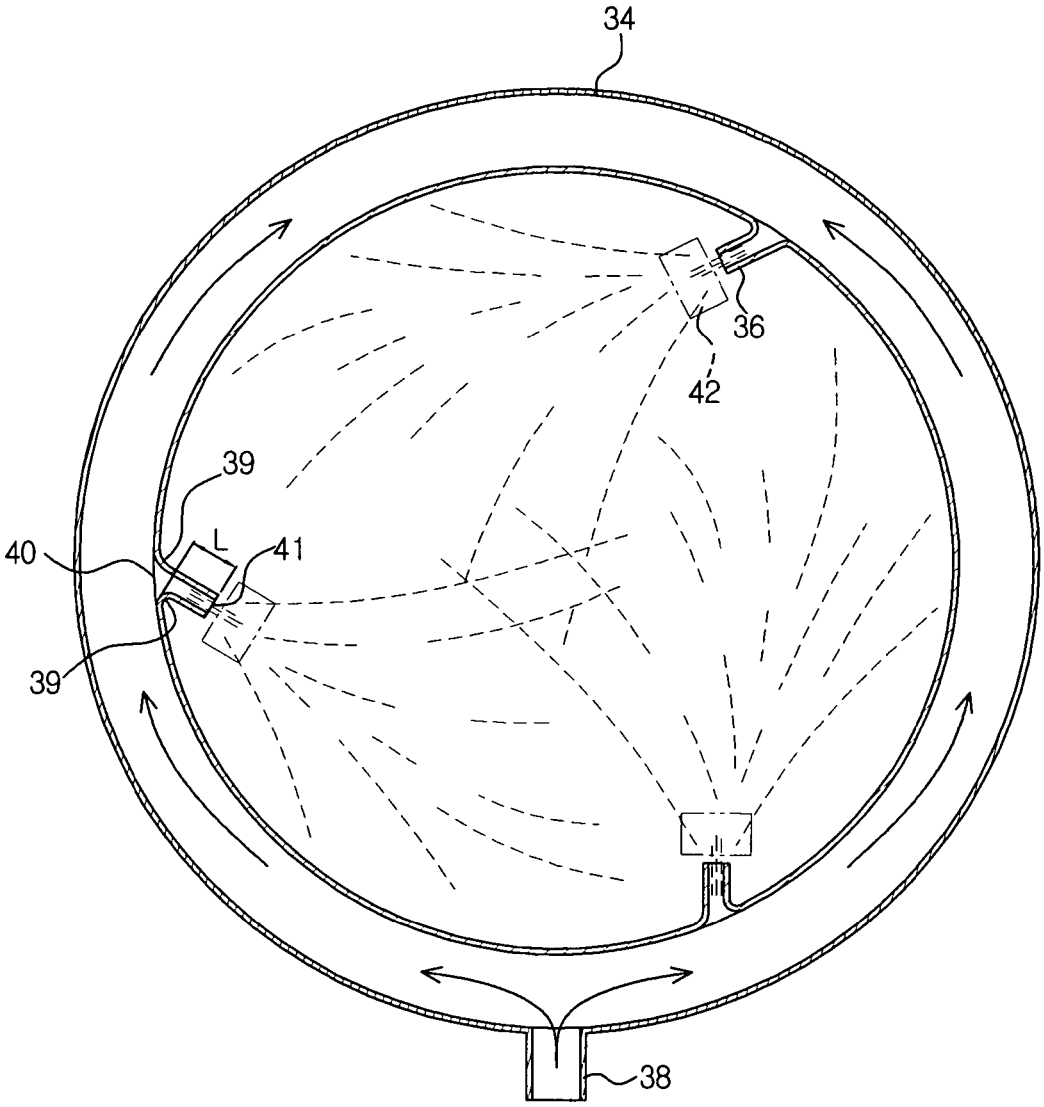
FIG. 6 is a transverse sectional view showing the water spray device according to an embodiment of the present invention.

FIG. 5 is a longitudinal sectional view showing the water spray device according to the present invention, and FIG. 6 is a transverse sectional view showing the water spray device according to the present invention.

As shown in FIGS. 5 and 6, the spray members 36 protrude from the inner peripheral surface of the diffusion duct 34 by a predetermined length. Since each spray member 36 has a linear section L branching from the diffusion duct 34, the washing water is sprayed in the extension direction of the spray member 34.

For the purpose of comparison, the spray direction of the washing water when spray holes are formed in the diffusion duct 34 will be described. The spray holes refer to holes formed in the inner peripheral surface of the diffusion duct 34 without the linear section protruding outward from the inner peripheral surface of the diffusion duct 34. In this case, when the washing water is sprayed through the spray holes, the washing water has specific directional component in the direction of the water path formed in the diffusion duct 34. Thus, the washing water sprayed through the spray holes may be biased in one direction, so that the laundry may not be sufficiently wetted by the washing water.

However, according to the present invention, since the spray members 36 have the linear section L, the directional component of the washing water may be offset while the washing water is passing through the linear section L of the spray member 36. This means that the spray direction of the washing water is determined according to the extension direction of the spray member 36 protruding from the diffusion duct 34. In this regard, the extension direction of the spray member 36 is determined by taking the spray direction of the washing water into consideration such that the laundry can be sufficiently wetted by the washing water.

In addition, a sectional area of the spray members 36 is smaller than a sectional area of the diffusion duct 34. The spray members 36 branch from the diffusion duct 34 while being spaced apart from each other by a predetermined interval such that hydraulic pressure applied to the spray members 36 can be constantly maintained. Since the sectional area of the diffusion duct 34 is larger than that of the spray member 36, the washing water can be rapidly supplemented to the diffusion duct 34 when the washing water is sprayed through the spray member 36. In addition, since the diffusion duct 34 serves as a water reservoir, uniform hydraulic pressure can be applied to the plural spray members 36. That is, the washing water can be sprayed through the plural spray members 36 with uniform hydraulic pressure, so that the laundry can be uniformly wetted by the washing water.

In addition, a guide member 42 having a rib shape is provided in the vicinity of an outlet port 41 of the spray member 36. The guide member 42 protrudes downward from the bottom of the cover 33. The shape of the washing water sprayed from the spray member 36 may vary depending on the shape of the guide member 42. Accordingly, the shape of the guide member 42 is determined by taking the shape of the washing water into consideration such that the laundry can be efficiently wetted. The washing water sprayed through the outlet port 41 of the spray member 36 is guided by the guide member such that the laundry can be efficiently wetted by the washing water.

In this regard, the spray member 36 protrudes while being biased to the right from the center of the outer tub 11 and the guide member 42 is designed such that the washing water can be widely spread. FIG. 6 shows the washing water sprayed from the water spray device 30. As shown in FIG. 6, the washing water is widely and uniformly sprayed by the water spray device 30, so that the laundry can be efficiently wetted by the washing water. In addition, since the washing water is sprayed while being biased to the right from the center of the outer tub 11, the washing water may form a swirl flow, so that the washing effect can be improved.

Referring again to FIG. 6, a connection part 39, which is smoothly bent in the form of an arc, is provided between the diffusion duct 34 and the spray member 36. The connection part 39 is located at a region where the spray member 36 branches from the diffusion duct 34. The flow of the washing water may be suddenly changed in the vicinity of the connection part 39. That is, since the spray members 36 branch from the diffusion duct 34 while being spaced apart from each other by a predetermined interval, some of the washing water flowing through the diffusion duct 34 is directed to the spray members 36. At this time, the flow of the washing water may be suddenly changed at the region where the spray member 36 branches from the diffusion duct 34 and the connection part 39 may interfere with the washing water so that the washing water may not smoothly flow. To solve the above problem, the connection part 39 is smoothly bent in the form of the arc. In this case, the connection part 39 can prevent the swirl flow of the washing water so that the washing water can be smoothly introduced into the spray member 36 from the diffusion duct 34. In addition, since the washing water can smoothly flow without interfering with the connection part 39, impurities may not be caught by the connection part 39, so that the spray members 36 can be prevented from clogging.

Figure 7:
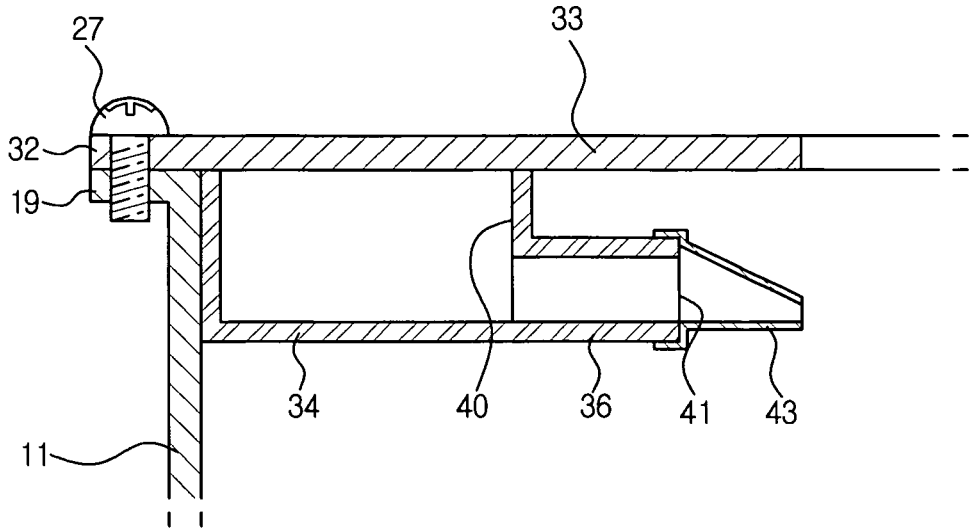
FIG. 7 is a longitudinal sectional view showing the water spray device according to a second embodiment of the present invention.
Figure 8:
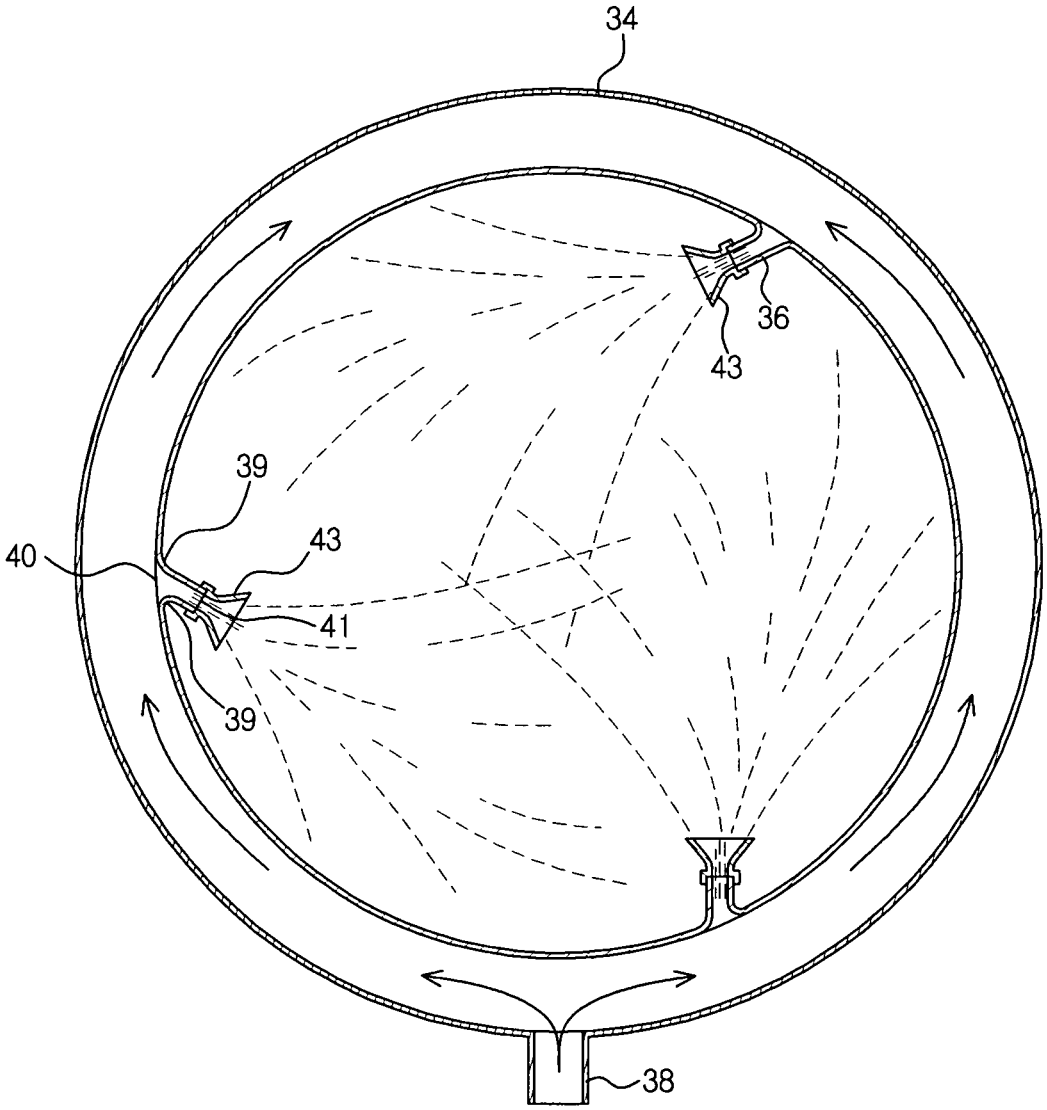
FIG. 8 is a transverse sectional view showing the water spray device according to the second embodiment of the present invention.
Figure 9:
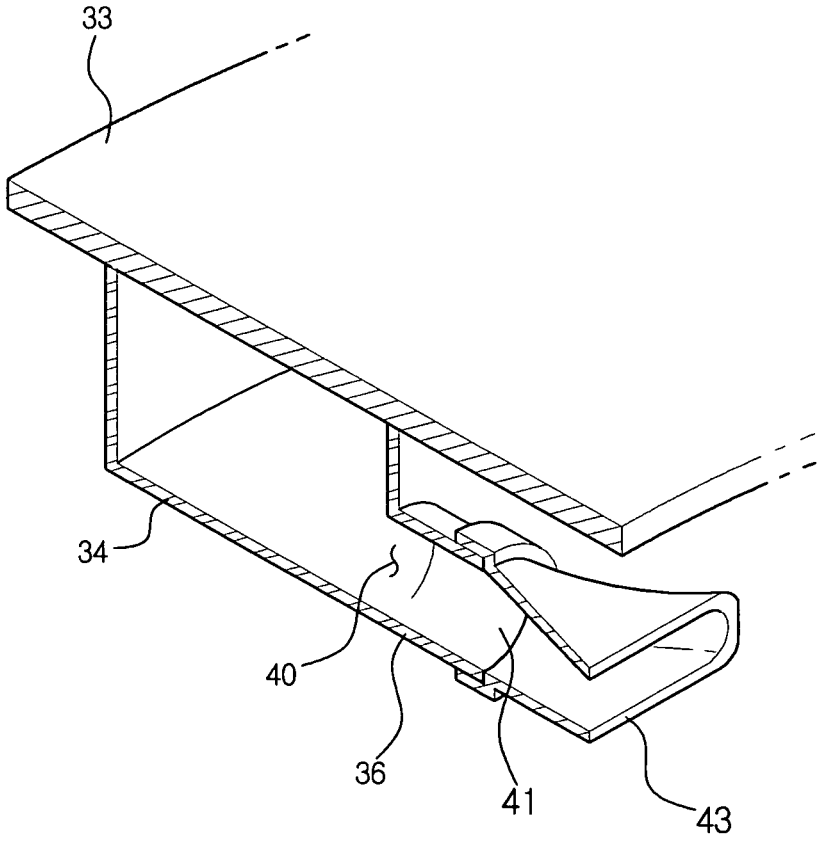
FIG. 9 is a partially-cut perspective view showing the water spray device according to the second embodiment of the present invention.

FIG. 7 is a longitudinal sectional view showing the water spray device according to a second embodiment of the present invention, FIG. 8 is a transverse sectional view showing the water spray device according to the second embodiment of the present invention, and FIG. 9 is a partially-cut perspective view showing the water spray device according to the second embodiment of the present invention.

As shown in FIGS. 7 to 9, the spray member 36 protrudes from the diffusion duct 34 by a predetermined length. The spray member 36 is separated from the cover 33 by a predetermined distance and forms a fluid path for the washing water independently from the cover 33. A spray nozzle 43 is press-fitted around the terminal end of the spray member 35 to guide the washing water sprayed from the spray member 36. The spray nozzle 43 can be integrally formed with the spray member 36.

The spray nozzle 43 has a function identical to that of the guide member 42 shown in FIG. 5. That is, the spray nozzle 43 allows the washing water sprayed from the spray member 36 to be widely spread, so that the laundry can be efficiently wetted by the washing water. The spray nozzle 43 may have various shapes, so that the washing water sprayed from the spray member 36 may have various shapes. In this regard, the shape of the spray nozzle 43 is determined by taking the shape of the washing water into consideration such that the laundry can be efficiently wetted by the washing water.

As shown in FIGS. 7 to 9, the spray nozzle 43 must not protrude out of the cover 33 when the spray nozzle 43 is assembled with the spray member 36. This configuration may allow the user to easily take out the laundry from the rotating tub 12 (see, FIG. 12).

Figure 10:
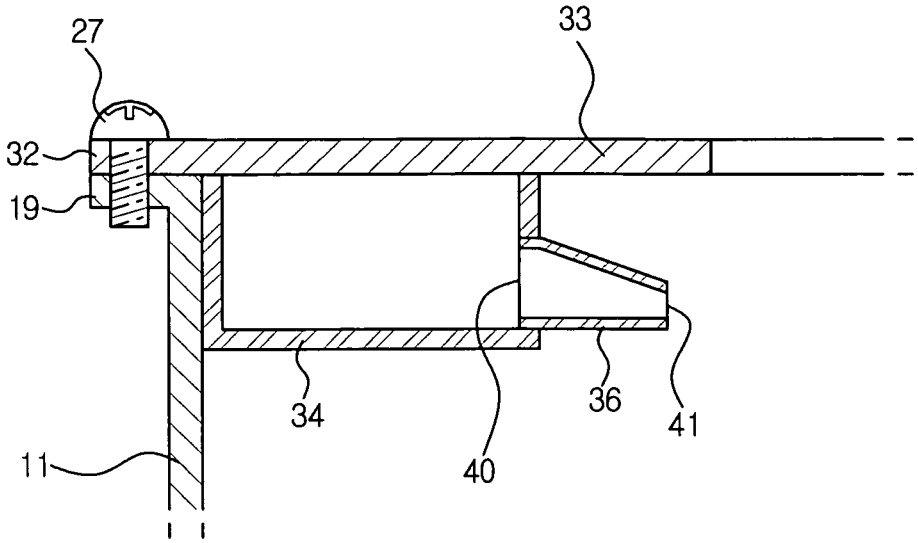
FIG. 10 is a longitudinal sectional view showing the water spray device according to a third embodiment of the present invention.

FIG. 10 is a longitudinal sectional view showing the water spray device according to the third embodiment of the present invention.

As shown in FIG. 10, the spray member 36 in the form of a nozzle is assembled with the diffusion duct 34. A section area of the inlet port 40 of the spray member 36 is larger than a sectional area of the outlet port 41 of the spray member 36. The spray member 36 may form a fluid path independently from the cover 33. In addition, since the sectional area of the outlet port 41 of the spray member 36 is very small, the washing water can be sprayed far away. In addition, the outlet port 41 of the spray member 36 may have a shape suitable for widely spreading the washing water, so that the laundry can be efficiently wetted by the washing water.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:
an outer tub;
a rotating tub rotatably installed in the outer tub;
a water spray device installed at an upper portion of the outer tub to spray washing water;
a circulation pump to pump washing water contained in a lower portion of the outer tub;
a circulation duct to guide the washing water pumped by the circulation pump to the water spray device; and
a drain pump to drain the washing water out of the washing machine,
wherein the water spray device comprises
a diffusion duct having a channel to diffuse the washing water pumped by the circulation pump around the outer tub;
a flat cover coupled to the upper end of the outer tub to cover an opened upper portion of the diffusion duct;
a spray member to guide the washing water so as to spray the washing water into the rotating tub; and
a water inlet port connected to the circulation duct such that the washing water pumped by the circulation pump is introduced into the water spray device and integrally formed with the diffusion duct.

2. The washing machine as claimed in claim 1, wherein
a sectional area of the spray member is smaller than a sectional area of the diffusion duct.

3. The washing machine as claimed in claim 1, wherein
the spray member has an inlet port connected to the diffusion duct and an outlet port spaced apart from the diffusion duct, wherein a sectional area of the inlet port is larger than a sectional area of the outlet port.

4. The washing machine as claimed in claim 1, wherein the water spray device comprises a guide member provided in the spray member to guide the washing water.

5. The washing machine as claimed in claim 4, wherein the guide member comprises a spray nozzle coupled with the spray member.

6. The washing machine as claimed in claim 4, wherein the guide member comprises a rib adjacent to the spray member.

7. The washing machine as claimed in claim 1, wherein
the spray member branches from the diffusion duct.

8. The washing machine as claimed in claim 1, wherein
an inner bottom surface of the diffusion duct and an inner bottom surface of the spray member are disposed on a horizontal plane.

9. A washing machine comprising:
an outer tub;
a circulation pump to pump washing water contained in a lower portion of the outer tub;

a circulation duct to circulate washing water pumped by the circulation pump from a bottom to a top of the outer tub;

a diffusion duct having a channel to diffuse the washing water pumped by the circulation pump around the outer tub;

a flat cover coupled to the upper end of the outer tub to cover an opened upper portion of the diffusion duct;

at least one water spray member to spray the washing water into the outer tub;

a water inlet port connected to the circulation duct such that the washing water pumped by the circulation pump is introduced into the water spray device and integrally formed with the diffusion duct; and a guide member to guide the washing water sprayed from the spray member, the guide member comprising a rib adjacent to the spray member, wherein the rib protrudes from a bottom of a cover located on the outer tub.

10. The washing machine as claimed in claim 9, wherein the spray member protrudes from the diffusion duct by a predetermined length.

11. The washing machine as claimed in claim 10, wherein the spray member protrudes while being biased from a center of the outer tub.

12. The washing machine as claimed in claim 9, wherein a sectional area of the spray member is smaller than a sectional area of the diffusion duct.

13. The washing machine as claimed in claim 9, wherein the spray member has an inlet port to receive the washing water and an outlet port to discharge the washing water, wherein the inlet port has a sectional area larger than a sectional area of the outlet port.

14. The washing machine as claimed in claim 9, wherein a connection part having a predetermined curvature is located between the diffusion duct and the spray member.

15. The washing machine as claimed in claim 9, wherein the diffusion duct comprises a diffusion tube formed below the cover to guide the washing water in a circumferential direction around the outer tub.

16. The washing machine as claimed in claim 9, wherein the spray member comprises a spray tube formed below the cover to guide the washing water into the outer tub.

17. The washing machine as claimed in claim 15, wherein the diffusion duct is formed by thermally welding the cover with the diffusion tube.

18. The washing machine as claimed in claim 16, wherein the spray member is formed by thermally welding the cover with the spray tube.

* * * * *